US009278574B1

(12) United States Patent
Zhang

(10) Patent No.: US 9,278,574 B1
(45) Date of Patent: Mar. 8, 2016

(54) DECORATING ARTICLE SET

(71) Applicant: Jimmy Jian Zhang, West Covina, CA (US)

(72) Inventor: Jimmy Jian Zhang, West Covina, CA (US)

( * ) Notice: Subject to any disclaimer, the term of this patent is extended or adjusted under 35 U.S.C. 154(b) by 0 days.

(21) Appl. No.: 14/714,178

(22) Filed: May 15, 2015

(51) Int. Cl.
*A47G 35/00* (2006.01)
*B44C 3/12* (2006.01)
*E04F 11/18* (2006.01)

(52) U.S. Cl.
CPC .. *B44C 3/12* (2013.01); *E04F 11/18* (2013.01)

(58) Field of Classification Search
CPC .. A47B 96/145; A47H 2001/006; E04C 1/42; E04F 11/18; E04F 11/1808; E04F 11/1817; E04F 11/1895; E04H 12/02; E04H 12/22; E04H 2017/006; E04H 2017/20; C03C 27/06; C03C 27/10; Y10T 428/131; A63J 21/00; A63J 99/00; B01D 17/02; B01D 17/12; B44C 3/12
USPC ..... 248/94, 148, 176.1, 188.1, 346.01, 248/346.03, 346.05, 346.06, 346.11, 346.2, 248/346.5, 370, 519, 694, 309.1, 310, 248/311.2, 314; 428/7, 11, 34.4, 542.2; D25/103, 108, 133, 135
See application file for complete search history.

(56) References Cited

U.S. PATENT DOCUMENTS

| | | | | |
|---|---|---|---|---|
| 2,709,217 | A * | 5/1955 | McClusky | 362/101 |
| 3,595,727 | A * | 7/1971 | Allen | 248/176.1 |
| 4,363,889 | A * | 12/1982 | Hoshino et al. | 523/513 |
| 4,783,938 | A * | 11/1988 | Palmer | E06B 3/6604 52/171.3 |
| 4,964,529 | A * | 10/1990 | Houston | 206/523 |
| 6,419,202 | B1 * | 7/2002 | Thurner | 248/525 |
| 7,131,618 | B2 * | 11/2006 | Berry et al. | 248/346.05 |
| 2002/0100195 | A1 * | 8/2002 | Hsu | 40/409 |
| 2002/0170214 | A1 * | 11/2002 | Lin | 40/409 |
| 2003/0147235 | A1 * | 8/2003 | Lin | F21S 10/002 362/101 |
| 2004/0179376 | A1 * | 9/2004 | Chan et al. | 362/806 |
| 2005/0132662 | A1 * | 6/2005 | Hornung | E06B 3/24 52/202 |
| 2011/0024709 | A1 * | 2/2011 | Lepper | 256/67 |
| 2012/0205331 | A1 * | 8/2012 | Stejskal et al. | 211/60.1 |

* cited by examiner

*Primary Examiner* — Humera Sheikh
*Assistant Examiner* — Seth Dumbris
(74) *Attorney, Agent, or Firm* — Tsz Lung Yeung

(57) ABSTRACT

A decorating article set includes a decorating article and a decorating article holder. The decorating article holder includes a holding element and a connecting member. The holding element has a securing cavity and is arranged to be securely attached on a decorating surface. The connecting member is configured from a material which is the same as that of the decorating article, and is secured in the securing cavity, and arranged to be connected to the decorating article. The decorating article is secured on the decorating surface through the holding element and the connecting member.

10 Claims, 7 Drawing Sheets

DECORATING ARTICLE SET

BACKGROUND OF THE PRESENT INVENTION

1. Field of Invention

The present invention relates to a decorating article set, and more particularly to a decorating article set which comprises a decorating article holder which is capable of securely mounting a glass or crystalline decorating article on a decorating surface.

2. Description of Related Arts

A conventional decorating article such as a glass decorative sphere is usually mounted on an object for decorating purpose. For example, a glass decorative sphere may be mounted on a top surface of a decorating column which is erected at a specific position for providing decoration. A wide variety of glass or crystalline decorative spheres and decorating columns have been developed in the market.

A deep-seated problem for the above-mentioned decorating article and decorating column is that it is rather difficult to mount the decorating article on the decorating column. Take a glass decorative sphere as an example. A glass decorative sphere usually has a top spherical portion and a flat supporting surface formed as a bottom surface of the glass decorative sphere. Some sorts of adhesive agents, such ultraviolet (UV) light curing adhesive, are commonly used to adhere the glass decorative sphere onto the decorating column, which is typically made of wooden, plastic or metallic material. Since the glass decorative sphere is generally very heavy, the bonding strength provided by the adhesive agent may not be strong enough and the glass decorative sphere may accidentally detach from the decorating column. The reason for this adhesive failure is due mainly to the fact that conventional adhesive agents are generally incapable of providing reliably strong bond between a glass or crystalline decorating article and a decorating column which is configured from a material other than glass or crystalline, such as wood.

As a result, there is a need to safely and reliably mount a decorating article on a decorating surface.

SUMMARY OF THE PRESENT INVENTION

Certain variations of the present invention provide a decorating article holder which is capable of securely mounting a decorating article on a decorating surface.

Certain variations of the present invention provide a decorating article holder which is capable of securely mounting a glass decorating article on a decorating surface which may be configured from a material other than glass or crystalline, such as wood, plastic or metal.

In one aspect of the present invention, it provides a decorating article set for being mounted on a decorating surface, comprising:

a decorating article configured from glass material; and a decorating article holder, which comprises:

a holding element having a securing cavity for being securely attached on the decorating surface; and a connecting member being configured from glass material and secured in the securing cavity, and arranged to be connected to the decorating article by an adhesive element, whereby the decorating article is secured on the decorating surface through the holding element and the connecting member.

In another aspect of the present invention, it provides a decorating article holder for securing a decorating article on a decorating surface, comprising:

a holding element having a securing cavity for being securely attached on the decorating surface; and a connecting member configured from a material which is the same as that of the decorating article, the connecting member being secured in the securing cavity, and arranged to be connected to the decorating article by an adhesive element, whereby the decorating article is secured on the decorating surface through the holding element and the connecting member.

This summary presented above is provided merely to introduce certain concepts and not to identify any key or essential features of the claimed subject matter.

DETAILED DESCRIPTION OF THE PREFERRED EMBODIMENT

Figure 1:
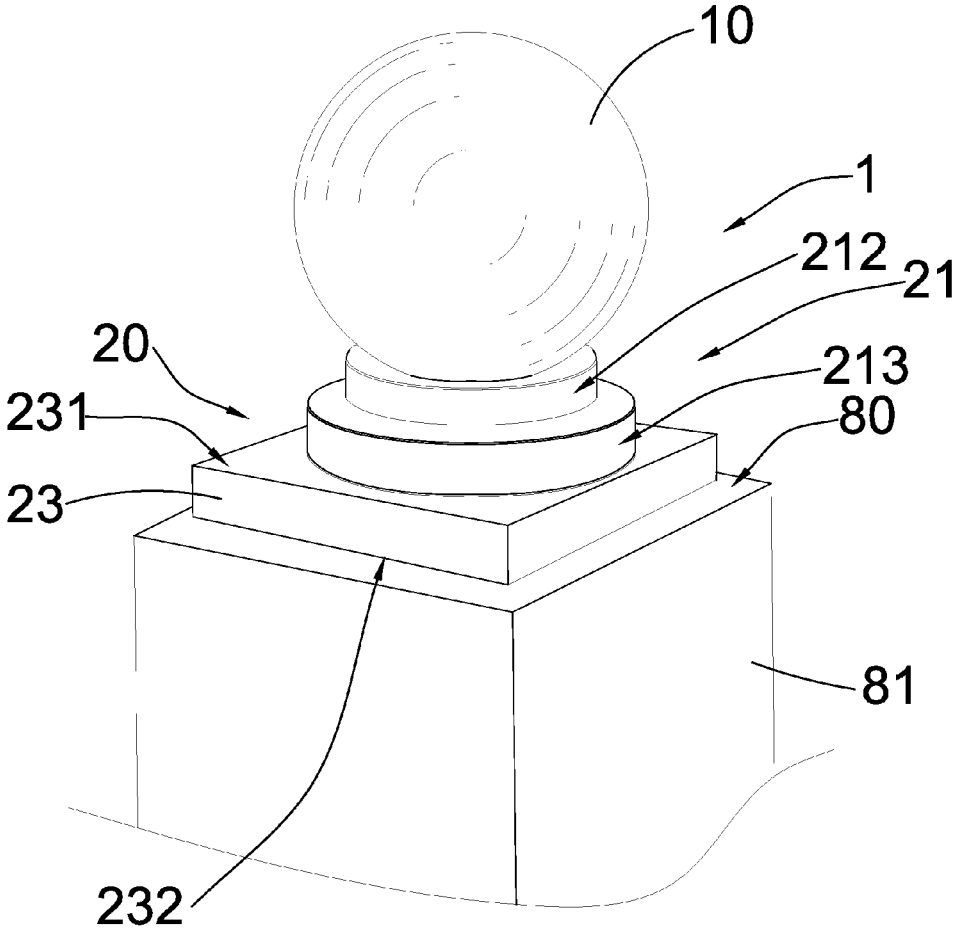
FIG. 1 is a perspective view of a decoration set according to a preferred embodiment of the present invention.

The following detailed description of the preferred embodiment is the preferred mode of carrying out the invention. The description is not to be taken in any limiting sense. It is presented for the purpose of illustrating the general principles of the present invention.

Referring to FIG. 1 to FIG. 4 and FIG. 5A to FIG. 5B of the drawings, a decorating article set 1 for being mounted on a decorating surface 80 according to a preferred embodiment of the present invention is illustrated. Broadly, the decorating article set 1 comprises a decorating article 10 and a decorating article holder 20. The decorating article 10 may be configured from glass material or crystalline material and have an attachment surface 11. As an example, the decorating article shown in FIG. 1 to FIG. 4 is of spherical shape and is a rigid, non-hollow structure. Since it is configured from glass or crystalline material, the decorating article 10 is transparent. The attachment surface 11 may be formed as a bottom flat surface of the generally spherical decorating article 10. It is important to mention, however, that the decorating article may have many different shapes or colors. These are also protected within the scope of the present invention.

The decorating article holder 20 may comprise a holding element 21 and a connecting member 22. The holding element 21 may have a securing cavity 211. The holding element 21 is for being securely attached on the decorating surface 80.

On the other hand, the connecting member 22 may be configured from a material which is the same as that of the decorating article 10. The connecting member 22 may be secured in the securing cavity 211, and is arranged to be connected to the decorating article 10 by a predetermined or suitable adhesive element, such that the decorating article 10 can be secured on the decorating surface 80 through the holding element 21 and the connecting member 22 of the decorating article holder 20.

Figure 5A:
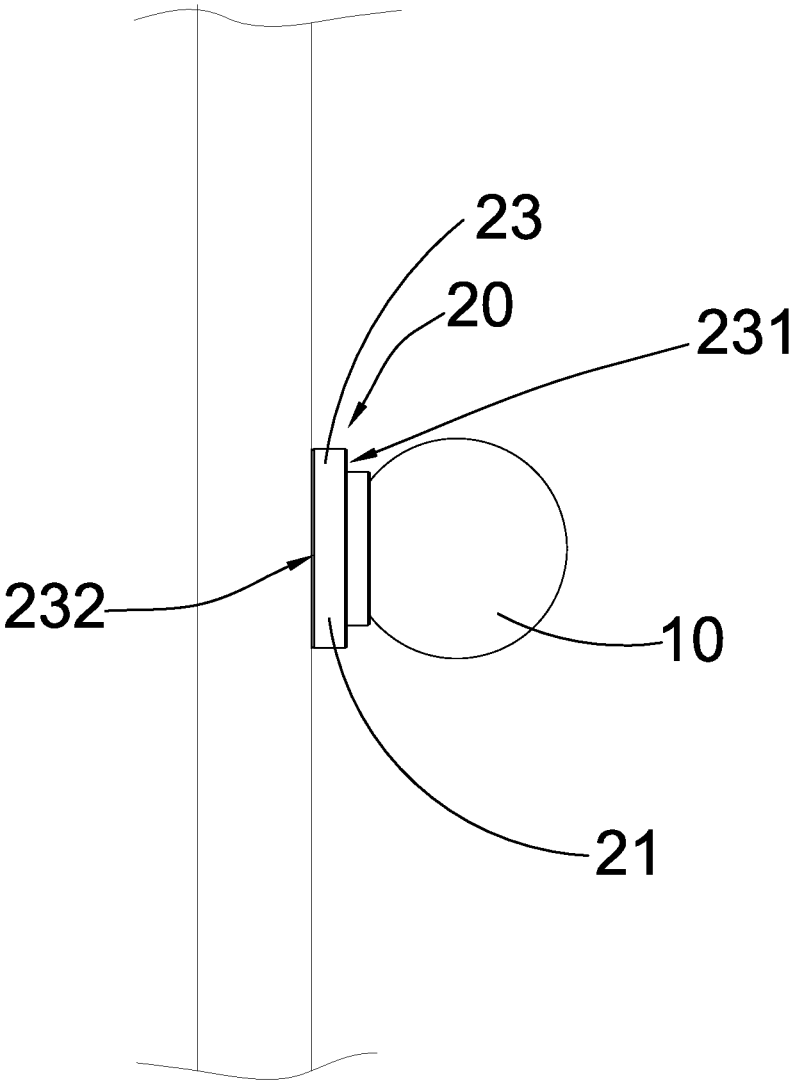
FIG. 5A and FIG. 5C are schematic diagrams of a decoration set according to the preferred embodiment of the present invention.

According to the preferred embodiment of the present invention, the decorating surface 80 may be formed as a top surface of a decorating column 81 so that the decorating article holder 20 may be used to securely and reliably mount the decorating article 10 on the decorating surface 80. The decorating surface 80 may also be part of a wall surface or a ceiling surface in a premises so that the decorating article holder 20 may also be used to securely and reliably mount the decorating article 10 on the relevant wall or ceiling surface (as shown in FIG. 5A of the drawings).

The decorating article holder 20 may further comprise a holder base 23 connected to a bottom side of the holding element 21 wherein the holder base 23 may be securely sandwiched between the holding element 21 and the decorating surface 80. The holder base 23 is for providing an alternative or additional mounting base for mounting the decorating article 10 on the decorating surface 80, and also for enhancing an aesthetic appearance of the decorating article holder 20 as a whole. The holder base 23 may also be necessary where direct connection of the holding element 21 on the decorating surface 80 is not appropriate or not feasible.

Figure 2:
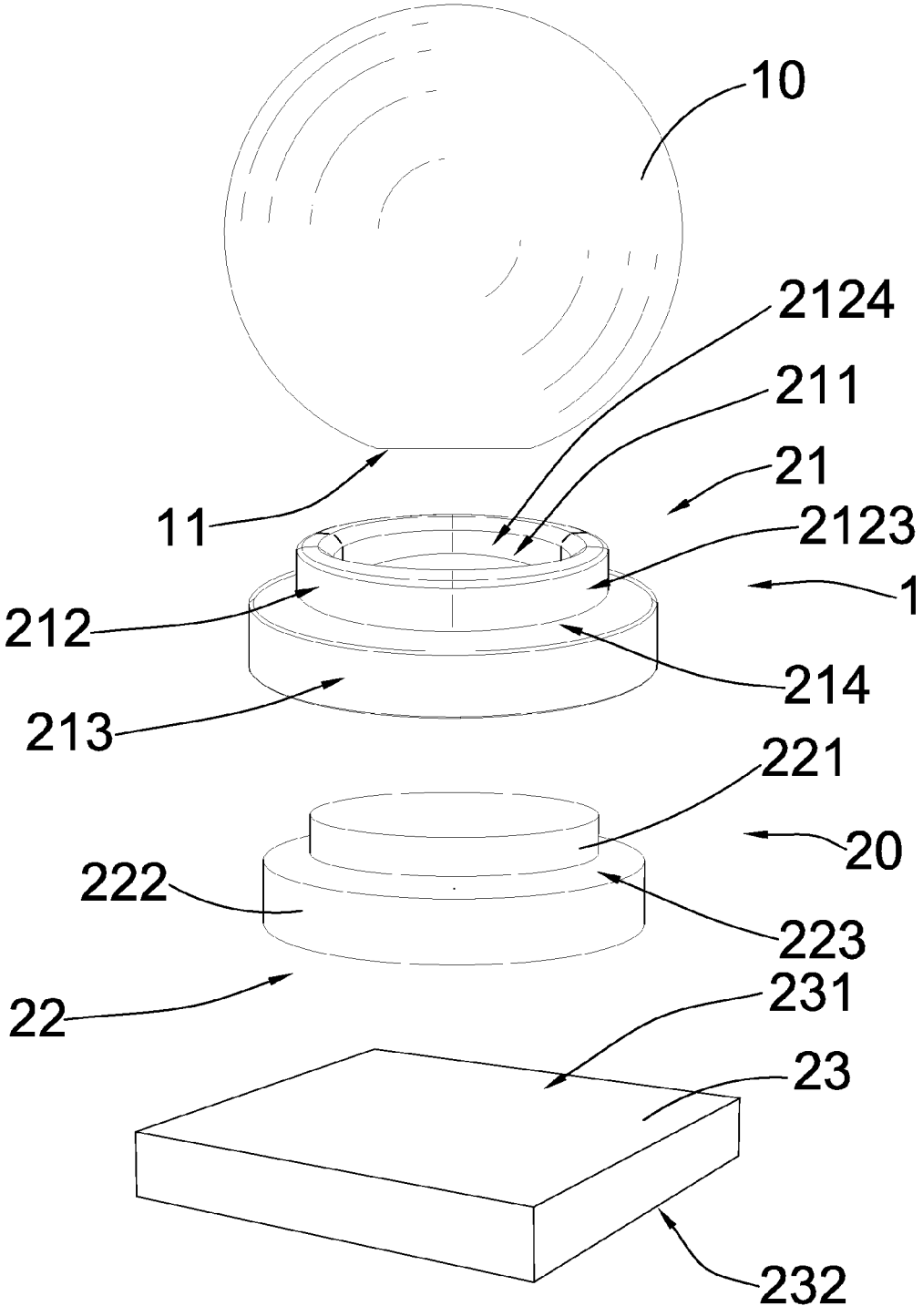
FIG. 2 is an exploded perspective view of the decoration set according to the preferred embodiment of the present invention.

As shown in FIG. 1 to FIG. 2 of the drawings, the holder base 23 may be configured as having a cubic or rectangular structure and has a top holding surface 231 and a bottom mounting surface 232. The bottom mounting surface 232 may be arranged to be in direct contact with the decorating surface 80. The top holding surface 231 may be arranged for supporting the holding element 21 and the connecting member 22. The holder base 23 may be securely connected to the decorating surface 80 by conventional connecting methods, such as gluing, screwing, or even welding so as to provide an adequate support and mounting strength for the heavy decorating article 10.

The holding element 21 may form an integral structure and have a top portion 212 and a bottom portion 213 for holding the connecting member 22. An exemplary configuration of the holding element 21 is that each of the top portion 212 and the bottom portion 213 is annular in structure (i.e. ring shape), in which the top portion 212 may have a through top opening 2121 whereas the bottom portion 213 may have a through bottom opening 2131. The top opening 2121 and the bottom opening 2131 may communicate with each other so as to form the securing cavity 211 of the holding element 21. Each of the top opening 2121 and the bottom opening 2131 may have a circular cross section.

Figure 3:
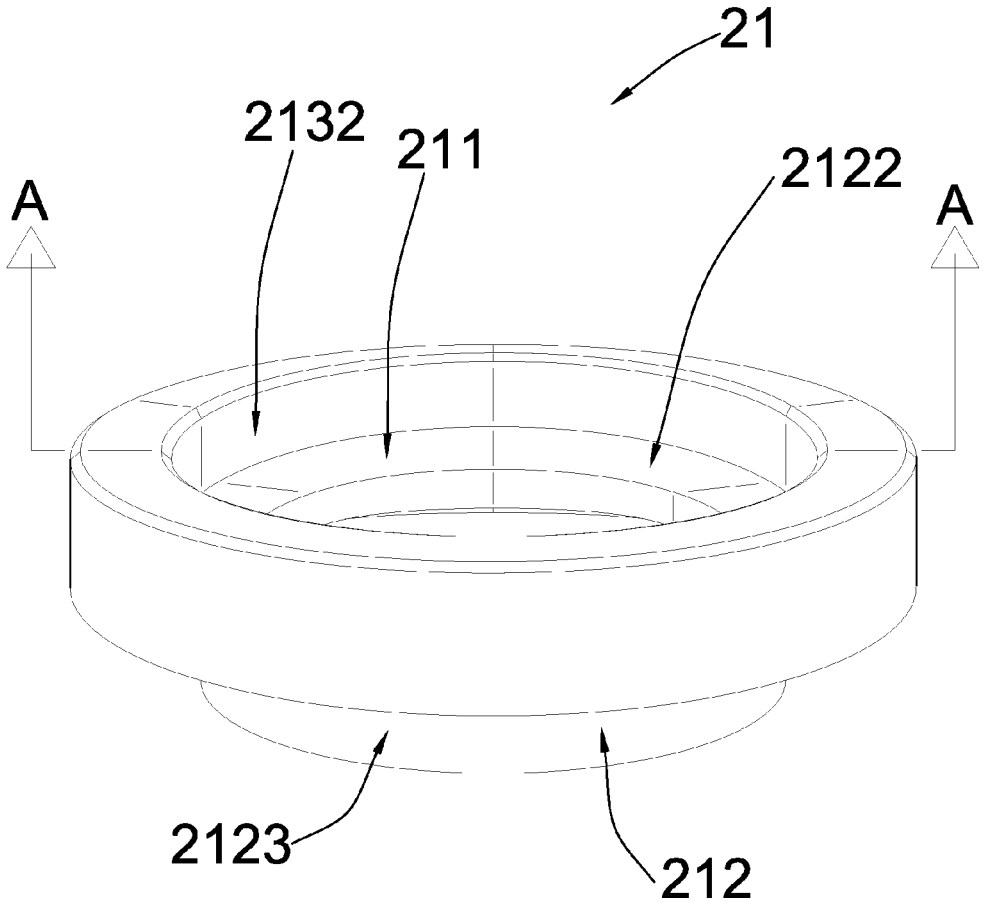
FIG. 3 is a schematic diagram of a decorating article holder according to the preferred embodiment of the present invention.
Figure 4:
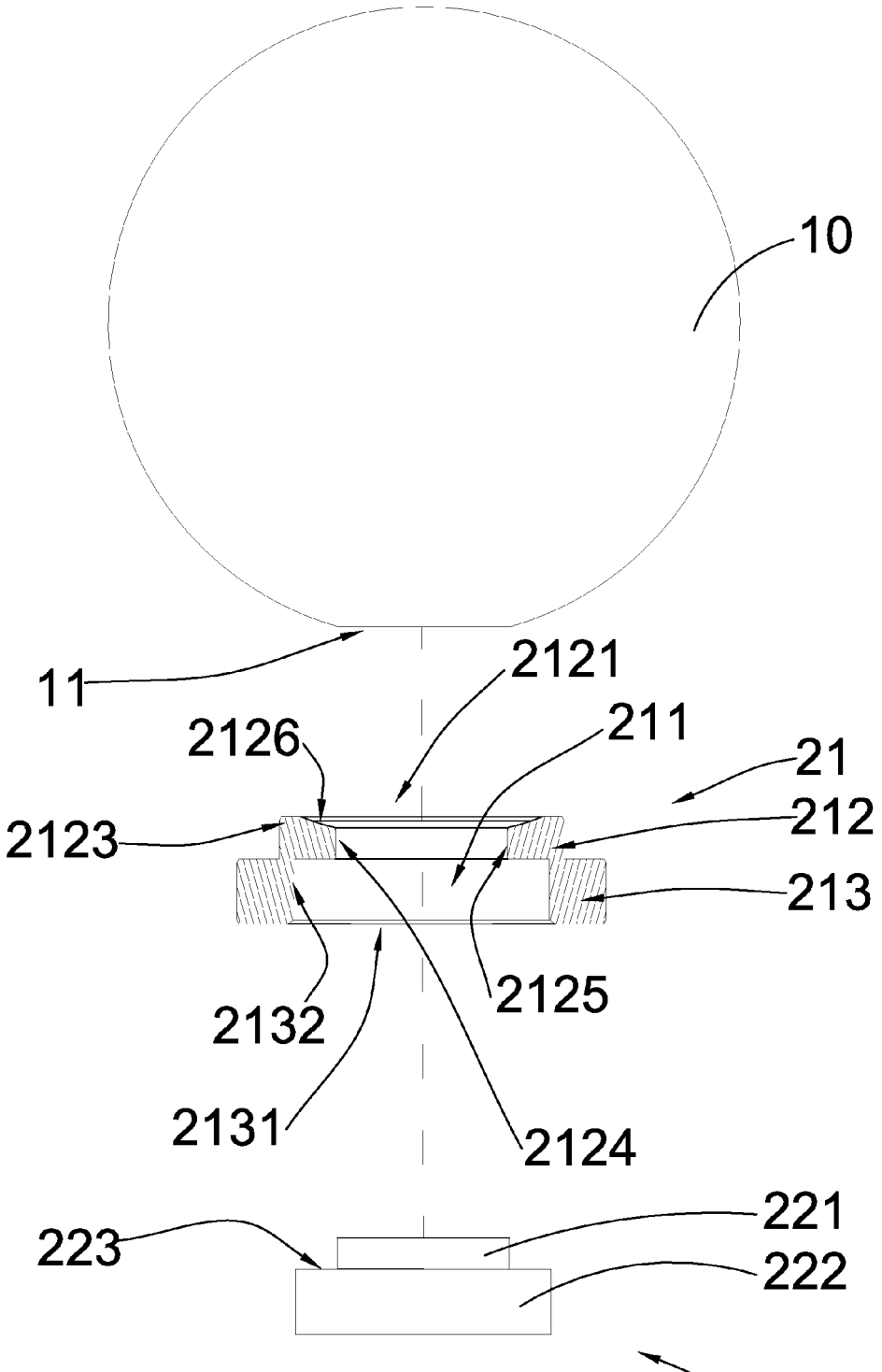
FIG. 4 is a sectional side view of a holding element of the decorating article holder along plane A-A of FIG. 3.

Referring to FIG. 2 to FIG. 4 of the drawings, in order to further understand the structural features of the holding element 21, the top portion 212 has an outer circumferential surface 2123, an inner circumferential surface 2124, and a bottom surface 2122. The inner circumferential surface 2124 is divided into a lower extending section 2125 and an upper extending section 2126. The lower extending section 2125 is vertically extends on the bottom portion 213 of the holding element 21. The upper extending section 2126 is upwardly, outwardly and slantingly extended from the lower extending section 2125. The upper extending section 2126 is also concavely curved to fittedly support the decorating article 10. A radius of curvature of the upper extending section 2126 may correspond to that of the decorating article 10 which may be generally spherical in shape.

As shown in FIG. 3 of the drawings, the securing cavity 211 may be defined as the space formed within the bottom surface 2122 of the top portion 212 and an interior circumferential surface 2132 of the bottom portion 213, plus the space surrounded by the lower extending section 2125 of the inner circumferential surface 2124 of the top portion 212. Thus, the connecting member 22 may be fittedly received in the securing cavity 211.

An external diameter of the top portion 212 may be smaller than that of the bottom portion 213 so as to form a first rim section 214 of the holding element 21. The first rim section 214 is formed between a top surrounding edge of the bottom portion 213 and a bottom surrounding edge of the top portion 212. The diameter of the top opening 2121 may be smaller than the diameter of the bottom opening 2131.

The connecting member 22 may be configured from glass or crystalline material so that the connecting member 22 may be attached to the attachment surface 11 of the decorating article 10 through adhesives, such as ultraviolet (UV) light curing adhesive. It is worth mentioning that the bonding strength between glass and glass or crystalline and crystalline by UV light curing adhesive is very strong, as compared to the bonding strength between two different materials, such as glass and wood.

The connecting member 22 may comprise a top connecting piece 221 and a bottom connecting piece 222. Each of the top connecting piece 221 and the bottom connecting piece 222 may be circular in cross section. A diameter of the top connecting piece 221 is smaller than that of the bottom connecting piece 222 so as to define a second rim section 223 between a bottom circumferential edge of the top connecting piece 221 and a top circumferential edge of the bottom connecting piece 222.

An outer diameter of the top connecting piece 221 is slightly smaller than an inner diameter of the lower extending section 2125 of the inner circumferential surface 2124 of the top portion 212 of the holding element 21. On the other hand, an outer diameter of the bottom connecting piece 222 is slightly smaller than an inner diameter of the interior circumferential surface 2132 of the bottom portion 213. Hence, the connecting element 22 may be securely accommodated in the securing cavity 211.

A height of the bottom connecting piece 222 of the connecting member 22 may be substantially the same as that of the bottom portion 213 of the holding element 21. A height of the top connecting piece 221 of the connecting member 22 may be substantially the same as lower extending section 2125 of the inner circumferential surface 2124 of the top portion 212 of the holding element 21. When the connecting member 22 is accommodated in the holding element 21, a top surface 2211 of the top connecting piece 221 may be arranged to be in direct contact with the attachment surface 11 of the decorating article 10. When a layer of UV adhesives is applied between the top surface 2211 and the attachment surface 11, the decorating article 10 may be securely attached on the connecting member 22.

By the above configuration, the holding element 21 may be securely attached on the decorating surface 80 through conventional methods and the attachment between them can be very strong and lasts for an extended period of time. The connecting member 22 is securely accommodated and supported in the holding element 21 and may be partially exposed to an exterior of the holding element 21 for attaching with the decorating article 10.

It is important to mention that the shape and size of the holding element 21 and the connecting member 22 may be varied depending on the circumstances in which the present invention is used. Moreover, the size and shape of the decorating article 10 may also be varied to correspond with a suitable decorating article holder 20.

Since the bonding strength between the holding element 21 and the connecting member 22 and the bonding strength between the holding element 21 and the holder base 23 are very strong, when the holder base 23 is securely attached on the decorating surface 80, the decorating article 10 may be securely attached to a wide variety of objects at virtually any orientation.

Figure 5B:
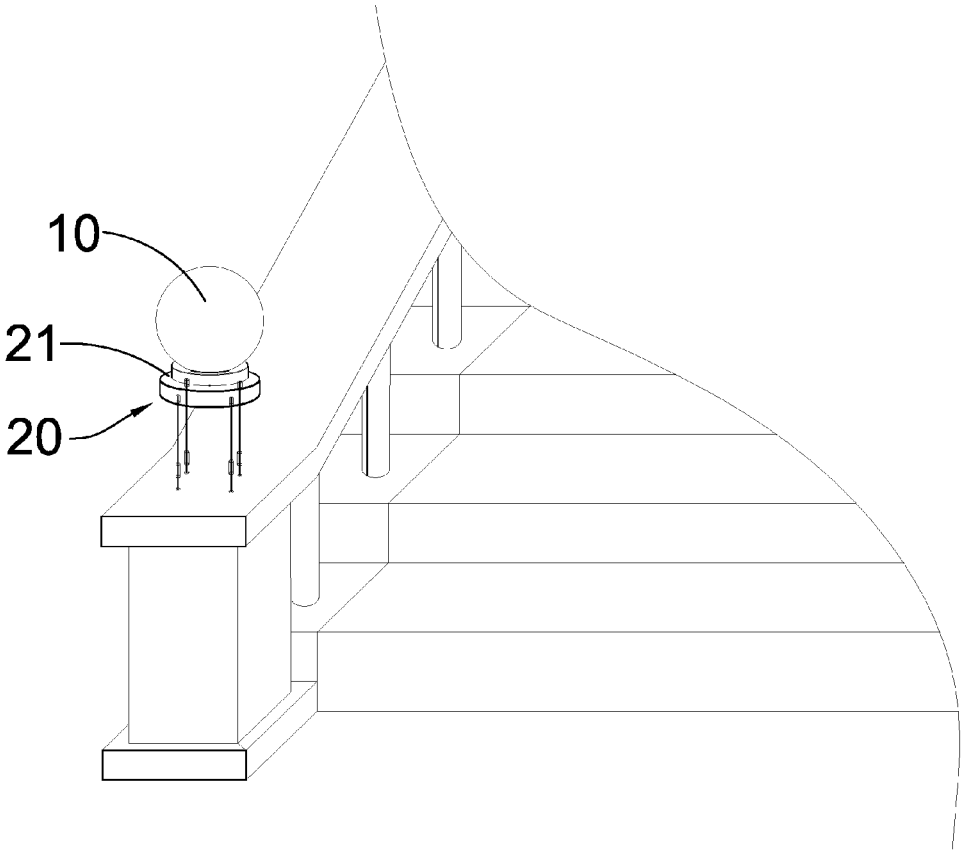
Figure 5C:
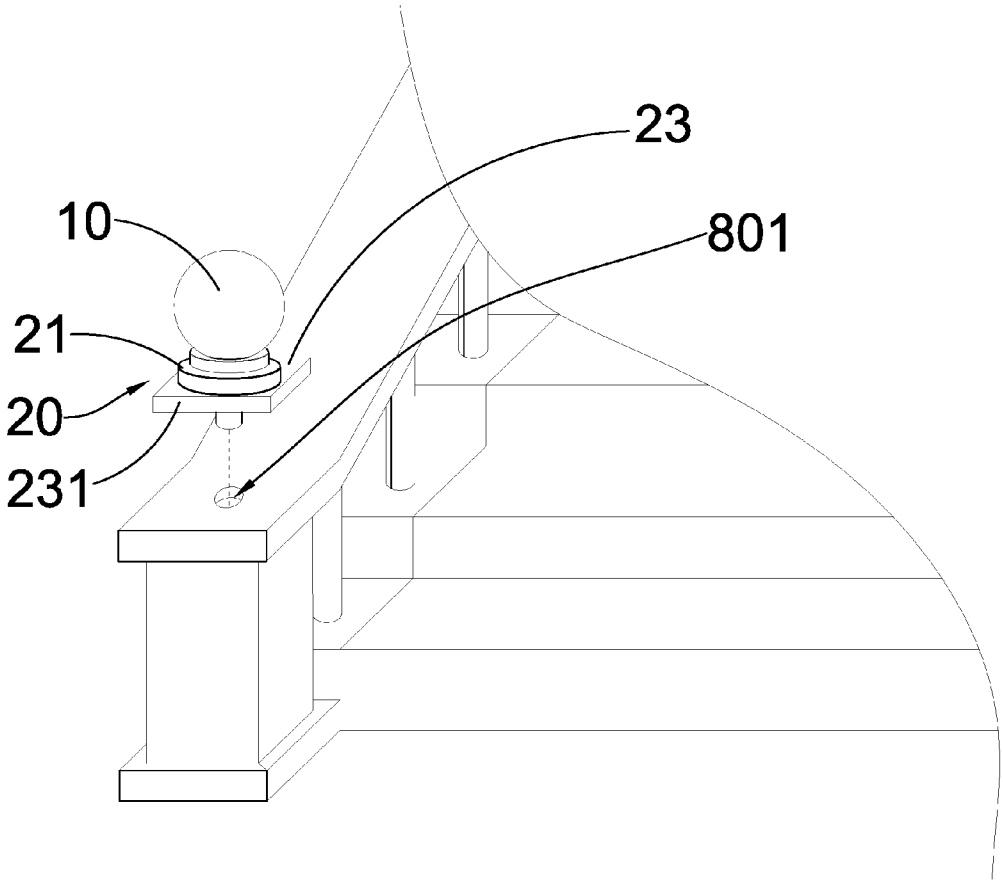

FIG. 5A illustrates a situation where the decorating article set of the present invention may be supported on a wall surface as the decorating surface 80 which extends vertically from the ground. Thus, the decorating article set may be suspendedly yet securely supported on a vertically extending wall. FIG. 5B illustrates a situation where the holder base 23 may be omitted. The holding element 21 may be directly attached on the decorating surface 80 through conventional methods, such as by screws. FIG. 5C illustrates a situation where the connection between the holder base 23 and the decorating surface 80 may be accomplished through a connecting pin 231 extended from the holder base 23. The connecting pin 231 is arranged to be securely inserted into a connecting slot 801 formed on the decorating surface 80. It is worth mentioning, however, that the connection between the holder base 23 and the decorating surface 80 may be accomplished by other methods.

The present invention, while illustrated and described in terms of a preferred embodiment and several alternatives, is not limited to the particular description contained in this specification. Additional alternative or equivalent components could also be used to practice the present invention.

What is claimed is:

1. A decorating article set for being mounted on a decorating surface, comprising:

a rigid non-hollow decorating article made of glass material, said decorating article being spherical in shape and having a flat attachment surface formed as a bottom surface thereof; and a decorating article holder, which comprises:

a holding element having a securing cavity for being securely attached on said decorating surface, said holding element having a top portion and a bottom portion, in which said top portion has a through top opening and said bottom portion has a through bottom opening, said top opening and said bottom opening communicating with each other to form a through central opening of said holding element, each of said top portion and said bottom portion being annular in structure, said top portion having an outer circumferential surface, an inner circumferential surface, and a bottom surface inwardly extended from said inner circumferential surface, said inner circumferential surface being divided into a lower extending section and an upper extending section, said lower extending section vertically extending from said bottom portion of said holding element, said upper extending section upwardly, outwardly and slantingly extending from said lower extending section, said upper extending section being concavely curved to fittedly support said decorating article, a radius of curvature of said upper extending section corresponding to that of said decorating article; and a connecting member made of glass material and fittedly secured in said securing cavity; and an adhesive element connecting said decorating article and said connecting member, whereby said decorating article is secured on said decorating surface through said holding element and said connecting member.

2. The decorating article set, as recited in claim 1, wherein an external diameter of said top portion is smaller than that of said bottom portion so as to form a first rim section between a top surrounding edge of said bottom portion and a bottom surrounding edge of said top portion, said diameter of said top opening being smaller than that of said bottom opening.

3. The decorating article set, as recited in claim 2, wherein said connecting member comprises a top connecting piece and a bottom connecting piece attached on said top bottom connecting piece.

4. The decorating article set, as recited in claim 3, wherein each of said top connecting piece and said bottom connecting piece is circular in cross section, a diameter of said top connecting piece being smaller than that of said bottom connecting piece to define a second rim section between a bottom circumferential edge of said top connecting piece and a top circumferential edge of said bottom connecting piece.

5. The decorating article set, as recited in claim 4, wherein an outer diameter of said top connecting piece is slightly smaller than an inner diameter of said lower extending section of said inner circumferential surface of said top portion of said holding element so that said top connecting piece is received in said top portion of said holding element, an outer diameter of said bottom connecting piece is slightly smaller than an inner diameter of said inner circumferential surface of said bottom portion so that said bottom connecting piece is received in said bottom portion of said holding element.

6. The decorating article set, as recited in claim 5, wherein a height of said bottom connecting piece of said connecting member is substantially the same as that of said bottom portion of said holding element, a height of said top connecting piece of said connecting member being substantially the same as that of said lower extending section of said inner circumferential surface of said top portion of said holding element.

7. The decorating article set, as recited in claim 1, wherein said decorating article holder further comprises a holder base connected to a bottom side of said holding element, said holder base being securely attached between said holding element and said decorating surface.

8. The decorating article set, as recited in claim 6, wherein said decorating article holder further comprises a holder base connected to a bottom side of said holding element, said holder base being securely attached between said holding element and said decorating surface.

9. A decorating article holder for securing a rigid non-hollow decorating article on a decorating surface, said decorating article being made of glass material, said decorating article holder comprising:

a holding element having a securing cavity for being securely attached on said decorating surface, said holding element having a top portion and a bottom portion for holding said connecting member, said top portion having a through top opening and said bottom portion having a through bottom opening, said top opening and said bottom opening communicating with each other to form a through central opening of said holding element, each of said top portion and said bottom portion being annular in structure, said top portion having an outer circumferential surface, an inner circumferential surface, and a bottom surface inwardly extended from said inner circumferential surface, said inner circumferential surface being divided into a lower extending section and an upper extending section, said lower extending section vertically extending from said bottom portion of said holding element, said upper extending section being upwardly, outwardly and slantingly extended from said lower extending section, said upper extending section being concavely curved to fittedly support said decorating article, a radius of curvature of said upper extending section being made and sized to correspond to that of said decorating article, an external diameter of said top portion being smaller than that of said bottom portion so as to form a first rim section between a top surrounding edge of said bottom portion and a bottom surrounding edge of said top portion, said diameter of said top opening being smaller than that of said bottom opening; and a connecting member made of glass material, said connecting member being fittedly secured in said securing cavity in such a manner that at least part of a top surface of said connecting member is not covered by said holding element so that said connecting member is arranged to be connected to said decorating article by applying an adhesive element on said top surface of said connecting member, said connecting member comprising a top connecting piece and a bottom connecting piece attached on a bottom surface of said top connecting piece, each of said top connecting piece and said bottom connecting piece being circular in cross section, a diameter of said top connecting piece being smaller than that of said bottom connecting piece to define a second rim section between a bottom circumferential edge of said top connecting piece and a top circumferential edge of said bottom connecting piece, an outer diameter of said top connecting piece being slightly smaller than an inner diameter of said lower extending section of said inner circumferential surface of said top portion of said holding element so that said top connecting piece is received in said top portion of said holding element, an outer diameter of said bottom connecting piece being slightly smaller than an inner diameter of said inner circumferential surface of said bottom portion so that said bottom connecting piece is received in said bottom portion of said holding element, wherein a height of said bottom connecting piece of said connecting member is substantially the same as that of said bottom portion of said holding element, a height of said top connecting piece of said connecting member being substantially the same as that of said lower extending section of said inner circumferential surface of said top portion of said holding element, whereby said decorating article is secured on said decorating surface through said holding element and said connecting member.

10. The decorating article holder, as recited in claim 9, wherein said decorating article holder further comprises a holder base connected to a bottom side of said holding element, said holder base being securely attached between said holding element and said decorating surface.

* * * * *